US007819180B2

(12) United States Patent
Zhou et al.

(10) Patent No.: US 7,819,180 B2
(45) Date of Patent: Oct. 26, 2010

(54) HIGH-ENERGY GAS FRACTURE APPARATUS FOR THROUGH-TUBING OPERATIONS

(75) Inventors: Zhihua Zhou, Xi'an (CN); Yuanhong Li, Xi'an (CN); Jun Liu, Xi'an (CN)

(73) Assignee: Tong Oil Tools Co., Ltd., Xian (CN)

( * ) Notice: Subject to any disclaimer, the term of this patent is extended or adjusted under 35 U.S.C. 154(b) by 87 days.

(21) Appl. No.: 11/664,850

(22) PCT Filed: Oct. 27, 2005

(86) PCT No.: PCT/CN2005/001772

§ 371 (c)(1),
(2), (4) Date: Oct. 31, 2008

(87) PCT Pub. No.: WO2006/045248

PCT Pub. Date: May 4, 2006

(65) Prior Publication Data

US 2009/0211746 A1 Aug. 27, 2009

(30) Foreign Application Priority Data

Oct. 29, 2004 (CN) ..... 2004 2 0086116 U

(51) Int. Cl.
*E21B 43/263* (2006.01)

(52) U.S. Cl. ..... 166/63; 166/177.5; 166/299; 102/318

(58) Field of Classification Search ..... 166/63, 166/177.5, 299; 102/317, 318
See application file for complete search history.

(56) References Cited

U.S. PATENT DOCUMENTS 1,816,100 A * 7/1931 Ulrik ..... 102/317
3,121,465 A * 2/1964 Stephens ..... 166/164
4,018,293 A * 4/1977 Keller ..... 175/4.5
4,064,935 A * 12/1977 Mohaupt ..... 166/63
4,530,396 A * 7/1985 Mohaupt ..... 166/63
4,798,244 A * 1/1989 Trost ..... 166/250.01
6,082,450 A * 7/2000 Snider et al. ..... 166/55.2
6,561,274 B1 * 5/2003 Hayes et al. ..... 166/311
6,817,298 B1 * 11/2004 Zharkov et al. ..... 102/312
7,487,827 B2 * 2/2009 Tiernan ..... 166/63

(Continued)

FOREIGN PATENT DOCUMENTS

CN 2170371 Y 6/1994

(Continued)

*Primary Examiner*—David J Bagnell
*Assistant Examiner*—Blake Michener
(74) *Attorney, Agent, or Firm*—Workman Nydegger

(57) ABSTRACT

Embodiments disclosed include a high-energy gas fracture apparatus for through-tubing operation. The apparatus includes a blast head, a fracturing body connected-with the blast head and an electric detonator provided in the blast head, the fracturing body having a central pipe sleeved by a fracture charge column outside and containing an explosive fuse sleeved by tubular igniting charge column inside. In an embodiment, charge amount per unit is effectively enhanced due to bared fracture charge column without sheath combustion gas peak pressure is reached quickly and therefore energy utilization rate during fracturing is effectively enhanced because of igniting by explosion energy of explosive fuse and combustion energy of igniting charge. Various embodiments are usable for fracturing or plug removal in a well without tubing.

6 Claims, 1 Drawing Sheet

U.S. PATENT DOCUMENTS

| | | | | |
|---|---|---|---|---|
| 7,565,930 | B2 * | 7/2009 | Seekford | 166/297 |
| 2003/0070812 | A1 * | 4/2003 | Robertson | 166/298 |

FOREIGN PATENT DOCUMENTS

| | | | |
|---|---|---|---|
| CN | 2208098 | Y | 9/1995 |
| CN | 2464936 | Y | 12/2001 |
| CN | 2560755 | Y | 7/2003 |
| RU | 2197612 | C2 | 4/2000 |

* cited by examiner

HIGH-ENERGY GAS FRACTURE APPARATUS FOR THROUGH-TUBING OPERATIONS

TECHNICAL FIELD

The present invention relates to oil exploration field, in particular to a high-energy gas fracture apparatus for through-tubing operation.

BACKGROUND OF THE UTILITY MODEL

During oil exploration, a high-energy gas fracture apparatus is a combustion-explosion apparatus, which applies a large magnitude of high-temperature and high-pressure gas generated by powder combustion to oil-gas bed, so as to remove plug and cause the strata near well to come into being a plurality of micro-cracks, thereby achieving the purpose of increasing production and injection.

High-energy gas fracture apparatus in prior art mainly use a charging structure with a metal housing or non-metal housing. However, such products can be only adapted for oil-gas well with a larger diameter. Chinese Patent No. CN 2170371 discloses a high-energy gas fracture multi-purpose generator, in which a bidirectional exhaust pipe not only is a charging vessel but also serves to release pressure. Such high-energy gas fracture apparatus employing charging structures with metal housing or non-metal housing have a relatively great outer diameter, and are difficult to be dropped into a predetermined layer through a tubing to perform the fracturing operation. On the contrary, such high-energy gas fracture apparatus can be used only before the tubing is dropped into a well or after a tubing string is lifted out from a well. Therefore, it is required many working procedure that the operation is complicated, and it is also difficult to control a well head when the stratum pressure is high. According to the known product structural principle, in order to pass through the oil-tubing, the charging amount must be decreased so as to reduce the outer diameter of the fracture apparatus. Because the charging amount per unit length is decreased, and the pressure elevating velocity of gas generated by the original igniting structural is slow, it can't be assured of necessary fracturing energy and operation effect. So far, no high-energy gas fracture tools for through-tubing operation have been proposed.

SUMMARY OF THE INVENTION

The present invention is directed to provide a high-energy gas fracture apparatus for through-tubing operation.

This invention provides a high-energy gas fracture apparatus for through-tubing operation, which comprises a blast head, a fracturing body connected with the blast head and an electric detonator provided in the blast head, the fracturing body having a central pipe sleeved by a fracture charge column outside and containing an explosive fuse sleeved by tubular igniting charge column inside.

In operation, the present fracture apparatus is dropped to a predetermined position in a well, and then the fracture apparatus is supplied with electrical power to cause the electric detonator and thus the explosive fuse to be detonated. The explosion energy generated by the explosive fuse ignites the igniting charge in the central pipe, and the combustion energy of the igniting charge ignites the fracture charge outside the central pipe through the cracks on the central pipe. The impinging of combustion gas generated by the fracture charge applies impact load to terrane at a relatively high speed, so that a number of cracks are formed in the terrane along a passage of each injecting hole.

A balance weight may be additionally provided on the blast head, so that the cable can be prevented from moving upwardly or twisting due to high pressure generated in the well cylinder.

Annular grooves and/or axial grooves may also be arranged on the wall of the central pipe, which serve as stress grooves, and is advantageous for the central pipe to be cracked upon igniting and detonating, so that the releasing manner of igniting charge energy can be adjusted in the central pipe, so as to enable control of the working pressure and time of the gas fracture apparatus.

Bared fracture charge column without sheath is used in the present invention, so that charging amount per unit length is effectively enhanced. Because of igniting by explosion energy of explosive fuse and combustion energy of igniting charge, the fracture charge column is directly ignited through cracks of the central pipe, combustion gas peak pressure is reached quickly and therefore energy utilization rate during fracturing is effectively enhanced, which is advantageous for fracturing rocks. The present invention has better effect in practice and ensures reliable and safe operation. Moreover, the present invention may also be used for directly fracturing or plug removal in an oil-gas well or a water-injected well without tubing.

DETAILED DESCRIPTION OF THE PREFERRED EMBODIMENTS

Figure 1:
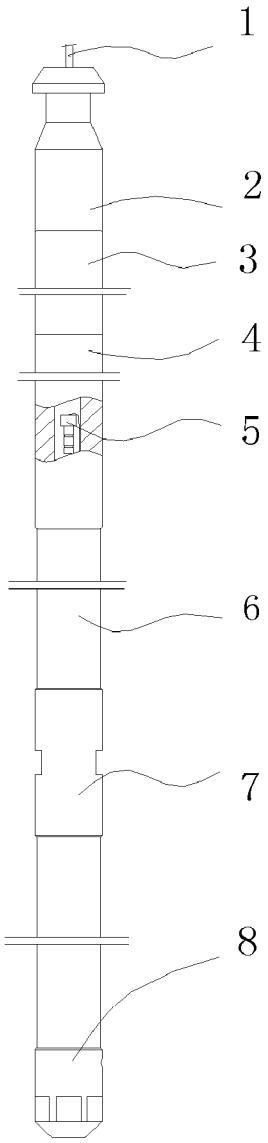
FIG. 1 is a generally structural view of this present invention.
Figure 2:
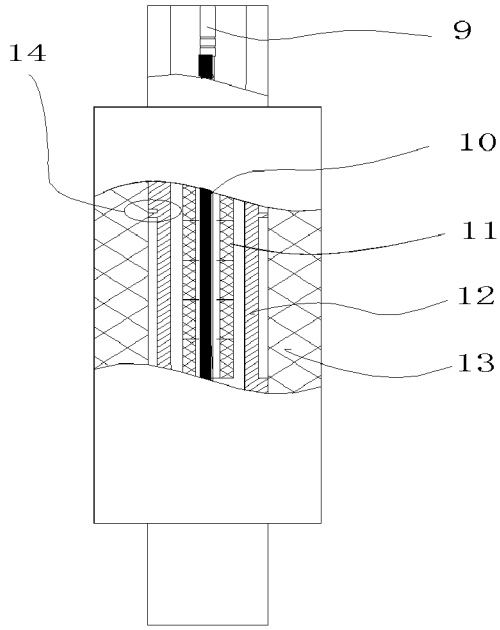
FIG. 2 is a structural view of the fracturing body shown in FIG. 1.

FIGS. 1 and 2 show a preferred embodiment of the present invention. The present fracture apparatus comprises a cable connector 2, a balance weight 3, a blast head 4 and a fracturing body 6, which are sequentially connected. The fracturing body 6 has a plurality of segments connected by pipe joints 7. A lower end of the last segment of the fracturing body 6 is connected with a bottom blocker 8. An electric detonator 5, which is connected with a cable 1, is provided in the blast head 4. The fracturing body 6 comprises a central pipe 12, an explosive fuse 10 provided in the central pipe 12, a tubular igniting charge column 11 sleeved around the center portion of the explosive fuse 10, and a fracture charge column 13 located outside the central pipe 12, with both ends of the explosive fuse 10 in each segment of the fracturing body 6 being enclosed with a detonation transmission tube 9. Three axial stress grooves 14 are arranged on the wall of the central pipe 12 with regular interval. After the present fracture apparatus is dropped to a predetermined position in a well by means of a cable, the fracture apparatus is supplied with electrical power to detonate in such way that the electric detonator 5 detonates the explosive fuse 10 arranged in an igniting structure, then the explosion energy generated by the explosive fuse 10 ignites the igniting charge, and the combustion energy of the igniting charge ignites the fracture charge through the cracks on the central pipe 12. Because the igniting energy is strong, and the igniting time difference between each segment of the fracturing body 6 is small, the impinging energy of the generated combustion gas applies impact load to terrane at a relatively high speed, so that a number of cracks are formed in the terrane along a passage of each injecting hole. During the whole high temperature and high pressure process, blocking impurity in original seepage gap can also be removed, and seepage flow rate can be recovered and increased.

What is claimed is:

1. A high-energy gas fracture apparatus for through-tubing operation, comprising a blast head, a fracturing body connected with the blast head and an electric detonator provided in the blast head, the fracturing body having a central pipe sleeved by a fracture charge column outside and containing an explosive fuse sleeved by tubular igniting charge column inside, wherein an annular groove is provided on an outer wall of the central pipe.

2. A high-energy gas fracture apparatus for through-tubing operation, comprising a blast head, a fracturing body connected with the blast head and an electric detonator provided in the blast head, the fracturing body having a central pipe sleeved by a fracture charge column outside and containing an explosive fuse sleeved by tubular igniting charge column inside, wherein an axial groove is provided on an outer wall of the central pipe.

3. A high-energy gas fracture apparatus for through-tubing operation, comprising a blast head, a fracturing body connected with the blast head and an electric detonator provided in the blast head, the fracturing body having a central pipe sleeved by a fracture charge column outside and containing an explosive fuse sleeved by tubular igniting charge column inside, wherein an annular groove is provided on an outer wall of the central pipe, and wherein an axial groove is provided on an outer wall of the central pipe.

4. A high-energy gas fracture apparatus for through-tubing operation, comprising a blast head, a fracturing body connected with the blast head and an electric detonator provided in the blast head, the fracturing body having a central pipe sleeved by a fracture charge column outside and containing an explosive fuse sleeved by tubular igniting charge column inside, wherein a balance weight is provided on the blast head, and wherein an annular groove is provided on an outer wall of the central pipe.

5. A high-energy gas fracture apparatus for through-tubing operation, comprising a blast head, a fracturing body connected with the blast head and an electric detonator provided in the blast head, the fracturing body having a central pipe sleeved by a fracture charge column outside and containing an explosive fuse sleeved by tubular igniting charge column inside, wherein a balance weight is provided on the blast head, and wherein an axial groove is provided on an outer wall of the central pipe.

6. A high-energy gas fracture apparatus for through-tubing operation, comprising a blast head, a fracturing body connected with the blast head and an electric detonator provided in the blast head, the fracturing body having a central pipe sleeved by a fracture charge column outside and containing an explosive fuse sleeved by tubular igniting charge column inside, wherein a balance weight is provided on the blast head, wherein an annular groove is provided on an outer wall of the central pipe, and wherein an axial groove is provided on an outer wall of the central pipe.

* * * * *